US007143624B2

(12) United States Patent
Stone et al.

(10) Patent No.: US 7,143,624 B2
(45) Date of Patent: Dec. 5, 2006

(54) FORGING APPARATUS AND CONVEYOR FOR FORMING COMPLEX ARTICLES

(76) Inventors: Paul Stone, 2807 Godfrey Rd., Glen Rock, PA (US) 17327; Ray Travis, 321 N. Lake Rd., Stevensville, MD (US) 21638

( * ) Notice: Subject to any disclaimer, the term of this patent is extended or adjusted under 35 U.S.C. 154(b) by 181 days.

(21) Appl. No.: 10/700,490

(22) Filed: Nov. 5, 2003

(65) Prior Publication Data

US 2005/0092052 A1 May 5, 2005

(51) Int. Cl.
*B21J 13/10* (2006.01)

(52) U.S. Cl. ..... 72/361; 72/346

(58) Field of Classification Search ..... 72/346, 72/344, 405.12, 353.2, 354.6, 20.5, 355.6, 72/405.09

See application file for complete search history.

(56) References Cited

U.S. PATENT DOCUMENTS 2,424,075 A * 7/1947 Brauchler ..... 72/354.6
2,513,710 A * 7/1950 Brauchler ..... 72/355.6
3,628,368 A * 12/1971 Cvacho et al. ..... 72/361
3,824,833 A * 7/1974 Bachmann ..... 72/361
4,644,775 A * 2/1987 Fuchs, Jr. ..... 72/348
6,125,683 A * 10/2000 Toeniskoetter ..... 72/426
6,192,285 B1 * 2/2001 Takayama ..... 700/56

FOREIGN PATENT DOCUMENTS

JP 5-177291 A * 7/1993

* cited by examiner

*Primary Examiner*—Derris H. Banks
*Assistant Examiner*—Debra Wolfe
(74) *Attorney, Agent, or Firm*—Dennison, Schultz & MacDonald

(57) ABSTRACT

A cold forging apparatus for forming complex shapes at a single station includes a first multiple function punch assembly having an inner and outer punch. A third punch or a second multiple function punch assembly is provided in a confronting relationship with the first multiple function punch assembly. A conveyor conveys a metal work piece from a supply source to a loading/unloading area between the first multiple function punch assembly and the third punch or second multiple function punch assembly. The conveyor includes a pivot assembly, a moveable J-shaped robot arm having an end effector fixed to one end thereof to rotate about the pivot assembly. A servo actuator and crank arm connected to one end thereof rotate the robot arm and end effector to convey a metal work piece from a supply source to a loading/unloading position and for conveying a forged product from the loading/unloading position to a storage area.

11 Claims, 15 Drawing Sheets

FORGING APPARATUS AND CONVEYOR FOR FORMING COMPLEX ARTICLES

BACKGROUND OF THE INVENTION

This invention relates to cold forging apparatus for forming complex articles and more particularly to cold forging apparatus for performing multiple functions at a single station. It also relates to a conveyor or loader/unloader for such apparatus.

Cold forging apparatus and processes are well-known. Such apparatus and processes have been used for many years in the commercial production of relatively simple parts at a single station or more complex parts with a multi station set up. However, for more complex parts, the use of a multi station process requires duplication of equipment, additional set-up time, additional space, multiple dies and additional costs. Such costs are particularly excessive for making a limited numbers of forged parts.

More complex parts may also be forged in a machine such as an automatic forging press or cam operated cold header. In such machines, parts are transferred through a variety of stationary die sets, each of which includes a punch. Such machines are capable of operating at high speeds, but are complex, expensive and require considerable set-up time before each run. Accordingly, the use of such machines is generally limited to high volume items where the length of the run justifies the set-up time. The use of such machines is also generally limited to parts which have sufficient complexity and sufficient market value to justify the costs of the machine, set-up time and other operating costs.

In our earlier application Ser. No. 10/291,361 which was filed on Nov. 12, 2002, we disclosed a cold forming apparatus for forming complex shapes at a single station. As disclosed therein, the apparatus includes a multi-function punch assembly including an inner and outer punch disposed on a common axis and a third punch in a confronting relationship with the first punch assembly. The apparatus also includes a die and a die holder for positioning a mass of metal or slug between the punches. A computer system controls movement of the punches and is programmable to form parts of different shapes at a single station.

It is now believed that there is a commercial market and need for an improved cold forging apparatus in accordance with the present invention. The reason for such demand is that such apparatus offer numerous advantages, for example, such apparatus are capable of forming complex shapes at a single station. Further, the apparatus requires less space and in some cases fewer operators than multiple machines each of which performs a single step in the production of a complex part. The apparatus as disclosed herein also require less set-up time which enables an operator to produce shorter runs at economical costs. This is because fewer stations and less tooling results in lower production costs, particularly in those cases involving smaller volumes of parts. A further advantages resides in a conveyor or loader/unloader for automatically or semi-automatically transferring a metal work piece or metal slug from a supply area to a loading/unloading area between the punches in a cold forging apparatus. The loader/unloader is also adapted to pick up a forged product from a loading/unloading area and unloading the forged product into a storage area or tray. Also, the loader/unloader in accordance with the present invention is adaptable for loading and unloading different apparatus.

A further advantage of the apparatus of the present invention resides in the use of multiple machines which includes conveyors in accordance with the present invention. Such machines may be slower than the aforementioned cam operated cold headers, but provide greater flexibility and backup in the event of a machine failure or down time for a more complex machine. In addition, cold forging apparatus in accordance with the present invention can be produced and sold at a competitive price. For example, it is presently estimated that the cost of a cold forging apparatus in accordance with the present invention is less than 25% of the cost of an automatic cam operated forging press. A still further advantage resides in the use of a computer program in conjunction with multiple sets of punches at a single station. It is also believed that the apparatus in accordance with the present invention will be less complex, less expensive to install, operate and maintain and more reliable than the automatic cam operated cold headers of the prior art. Recognizing, that the prior art automatic cam operated cold headers are capable of relatively fast speeds, it is believed that the use of two, three or more machines in accordance with the present invention will be capable of matching those speeds while providing many of the aforementioned advantages including costs and added flexibility.

BRIEF SUMMARY OF THE INVENTION

In essence, the present invention contemplates a conveyor or loader/unloader for conveying a metal work piece or slug from a supply source to a loading/unloading position between a die and a punch in a forging apparatus. The conveyor or loader/unloader is also adapted to convey a forged or finished product from the loading/unloading position to a storage area or tray. The conveyor or loader/unloader includes a pivot assembly and a moveable robot arm having an end effector fixed to one end thereof and an opposite end attached to the pivot assembly for movement about a first axis. In addition, the loader/unloader includes a servo actuator and a crank arm which is connected at one end thereof to the servo actuator and at an opposite end to the pivot assembly for rotating the robot arm through an arc about the first axis in response to movement of the servo actuator means for controlling movement of the servo actuator are also provided.

The end effector in accordance with the present invention includes first and second carrier elements or grips with the first element attached to or preferably rigidly fixed to one end of the robot arm. The second carrier element or grip is pivotally connected to the first carrier element for movement or rotation about a second axis. Further, the first and second carrier are adapted to receive a work piece slidably engaged therein when in a normal or closed position.

The second of the carrier elements or grips also includes an upper concave portion or surface which is adapted to receive a forged or final product thereon when in its normal position and an outwardly extending finger. An unloading actuator or pin is provided for engaging the outwardly extending finger as the robot arm rotates about the first axis to tilt the second element and drop a forged product into a storage tray or the like. Means are also provided for returning the second carrier element to its closed or work piece receiving position as the robot arm is returned to a neutral position or work piece loading position.

A preferred embodiment of the invention contemplates a cold forging apparatus for performing multiple functions at a single station to form complex shapes. The apparatus includes a first multiple punch assembly including a first inner punch and a first outer punch which are moveable along a common axis with respect to one another. It also includes a third moveable punch which is moveable along a second axis which intersects with the first common axis or along the first axis. Means are also provided for moving the punches individually along their respective axes. The apparatus in accordance with the preferred embodiment of the invention also includes means such as a die holder or press for positioning a die between the first multiple function punch assembly and the third punch. A programmable logic control, multi axis controller and a feed back device for controlling movement of the punches are also provided. Further, the apparatus includes a loading/unloading position between the first multiple punch assembly and the third punch and a conveyor or loader/unloader for conveying a metal work piece or slug from a supply area to the loading/unloading position and for conveying a forged product from the loading/unloading position to a storage area or tray. In this embodiment of the invention, the movement of the conveyor or loader/unloader is controlled by the feed back device and the work piece is moved into the die by one of the punches. One of the punches is also used to move a forged product out of the die and onto the second carrier element by one of the punches. The invention will now be described in connection with the following figures wherein like reference numerals have been used to designate like parts.

DETAILED DESCRIPTION OF THE INVENTION

Figure 1:
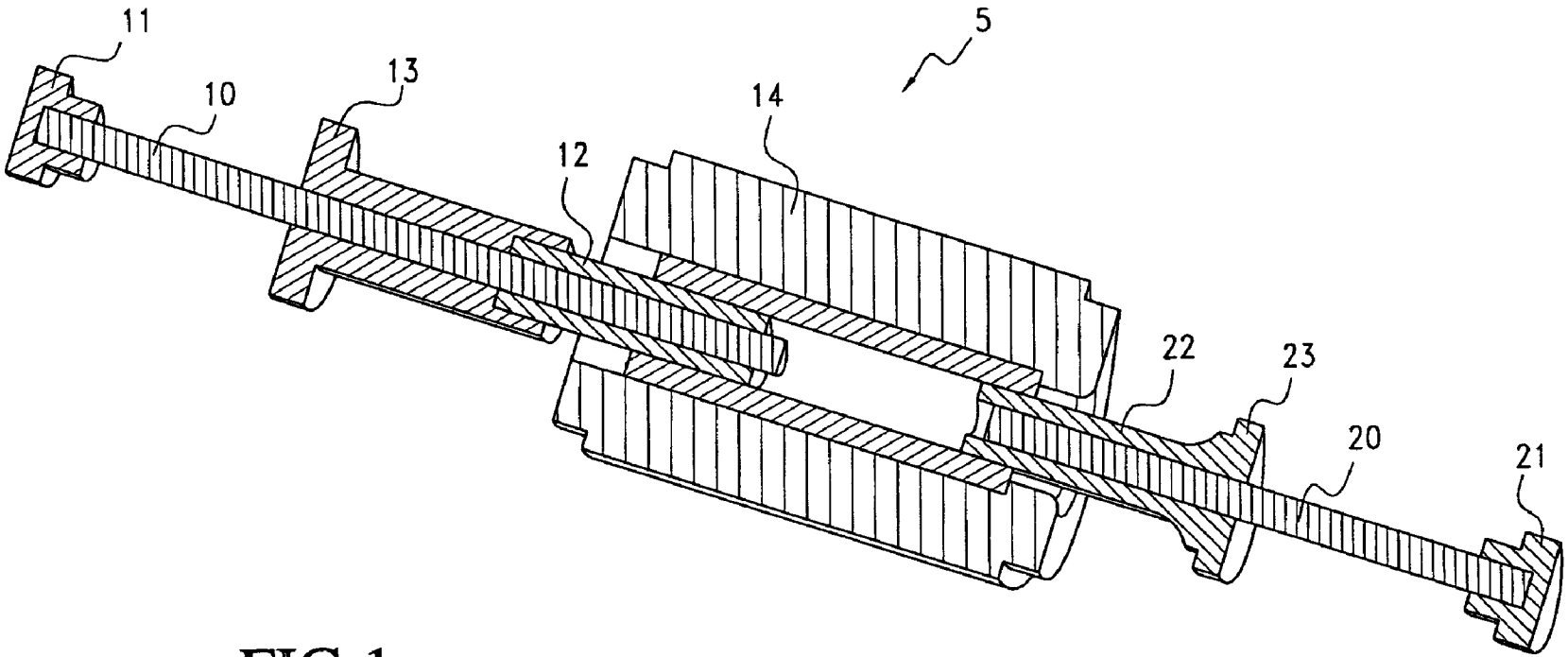
FIG. 1 is a sectional view of confronting coaxial multiple punch assemblies in accordance with a first embodiment of the invention.
Figure 2:
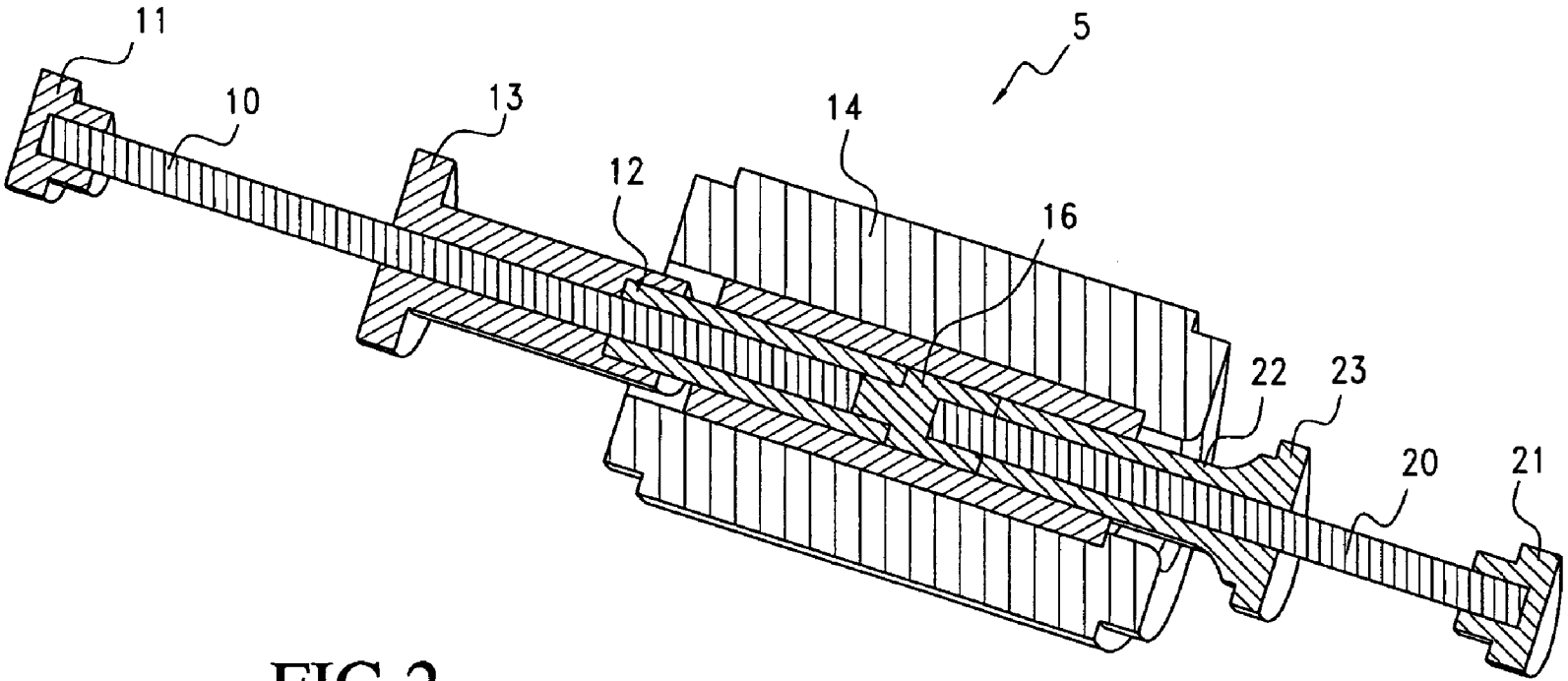
FIG. 2 is a sectional view of the multiple punch assembly as shown in FIG. 1 with the multiple punches in different positions.

FIGS. 1 and 2 illustrate a portion of a cold forging apparatus in accordance with the present invention. As illustrated, a pair of coaxial confronting multiple punch assemblies are constructed and arranged to perform multiple functions or steps at a single station. As shown, a first multiple punch assembly includes a first inner punch 10 and a first outer punch 12 disposed on a common axis in a telescopic relationship so that each of the first inner punch 10 and outer punch 12 are separately controllable and free to move independently along the common axis. The punches 10 and 12 include enlarged end portions or driving elements 11 and 13, respectively, at one end thereof for applying force to each of the punches. The opposite ends of the punches 10 and 12 are shown within a die 14.

The apparatus also includes a third punch which moves independently of the first inner punch 10 and first outer punch 12 along an axis that intersects the common axis of the first inner punch 10 and first outer punch 12. However, in one preferred embodiment of the invention, the third punch is replaced by a second multiple punch assembly.

The second multiple punch assembly is similar to the first multiple punch assembly and includes a second inner or central punch 20 and a second outer punch 22 disposed on a common axis in a telescoping relationship. The punches 20 and 22 are like the punches 10 and 12 separately controllable and free to move independently along the common axis. The punches 20 and 22 also include enlarged end portions or driving elements 21 and 23, respectively, at one end thereof for applying force to each of the punches. The opposite ends of the punches 20 and 22 are shown within a die 14.

Figure 3A:
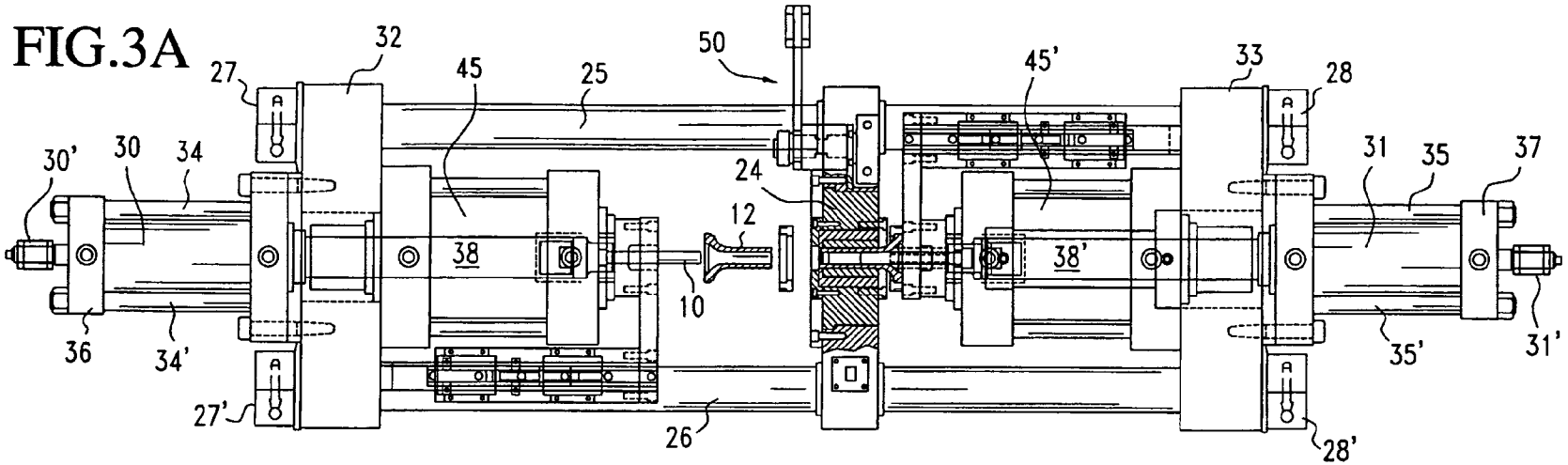
FIG. 3A is a top or plan view of the cold forging apparatus according to one embodiment of the invention.
Figure 3B:
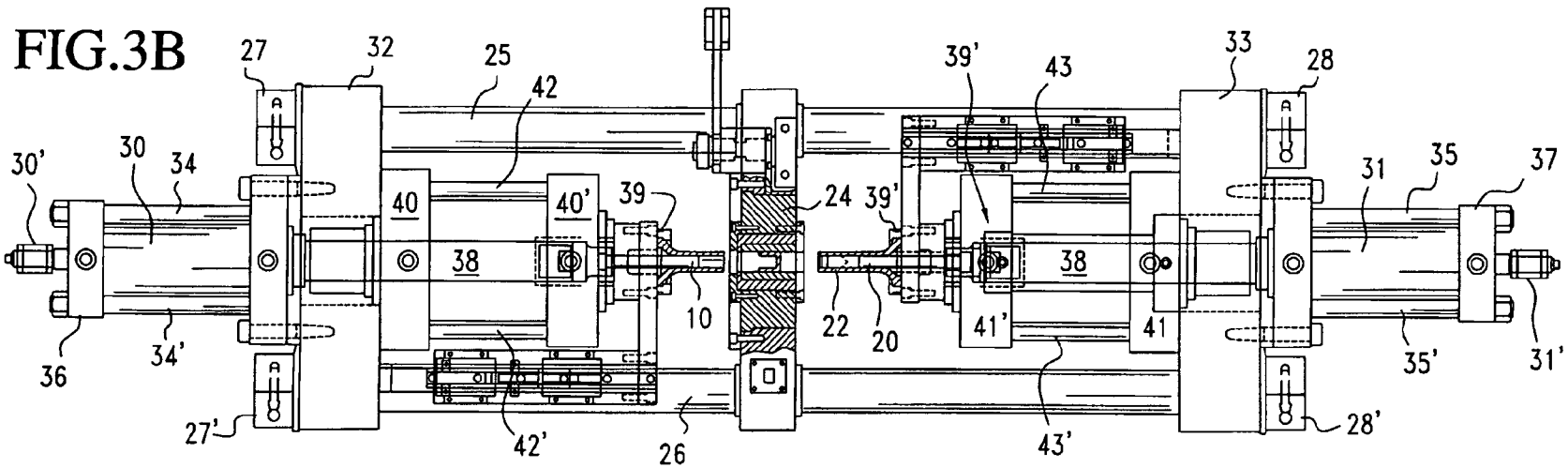
FIG. 3B is a top or plan view of the cold forging apparatus as shown in FIG. 3A with the outer punch fixed to a press and with a forged part within a die.
Figure 5:
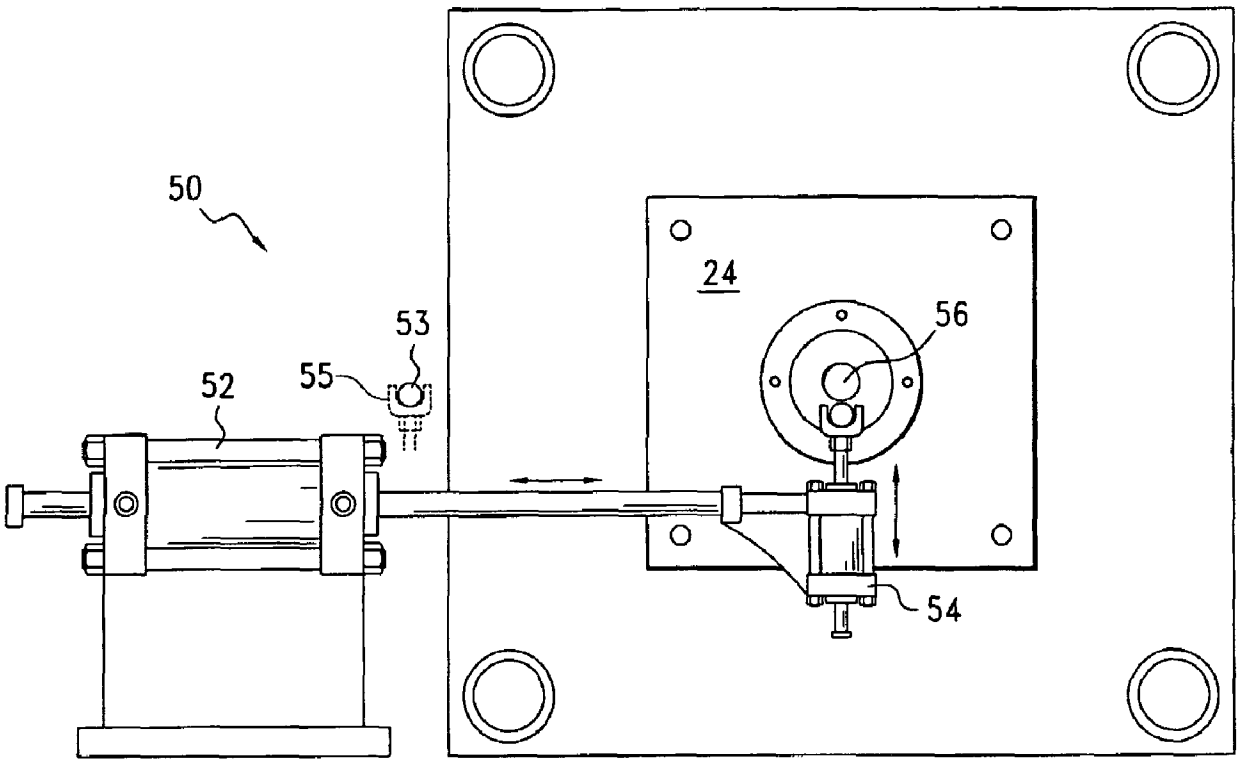
FIG. 5 is a schematic illustration of a conventional loader for use in connection with the present invention.

A cold forging apparatus in accordance with one embodiment of the invention is illustrated in FIGS. 3A and 3B wherein a central platen or die carrier 24 is shown in different positions. The apparatus includes a tie bolt assembly including two bolster plates 32 and 33 which are tied together by four bars or rods 25 and 26 (only two shown) and held together in a conventional manner as indicated by nuts 27, 27', 28 and 28'. A loader/unloader mechanism 50 may also be mounted on the die carrier 24 for automatic or semiautomatic loading of the die 14 by moving a metal slug or blank from a loading area to a position between the punches as shown in FIG. 5. However, an improved loader/unloader mechanism in accordance with a presently preferred embodiment of the invention will be described hereinafter in connection with FIGS. 7–15.

The apparatus in accordance with the invention also includes hydraulic cylinders 30 and 31 which are outside of the press frame at opposite ends thereof and which are held to the bolster plates 32 and 33 by the bolts 34, 34', 35 and 35', end caps 36 and 37 and a plurality of nuts in a conventional manner. Each of the hydraulic cylinders 30 and 31 is connected to a source of hydraulic pressure (not shown) by connectors 30' and 31'.

The cylinders 30 and 31 drive cylinder rods 38 and 38' along a common axis. The cylinder rods 38 and 38' are connected to the center or inner punch 10 and 20, respectively, by any suitable connectors 39, 39'. The apparatus also includes a pair of cylinders 45, 45' which are disposed within the press frame. These cylinder assemblies include forward and rear end caps 40, 41, forward end caps 40', 41' and tie rods 42, 42', 43 and 43'. The cylinders 45 and 45' are each connected to separate sources of hydraulic pressure (not shown) in a conventional manner. The cylinders 45, 45' also include a center passageway or hole through which the cylinder rods 38 and 38' pass.

The cylinders 45, 45' each comprise a multi-ended cylinder assembly preferably a double ended rod assembly with a seal at each end and a hole or passageway drilled through the center of the rod. This hole or passageway allows the extension or rods 38 and 38' to pass through the center of the rods. It is also contemplated that a second and third multi-ended cylinder rod could be used to allow for 3 or more axially nested punches for performing synchronous forming steps inside of a die.

Figure 4B:
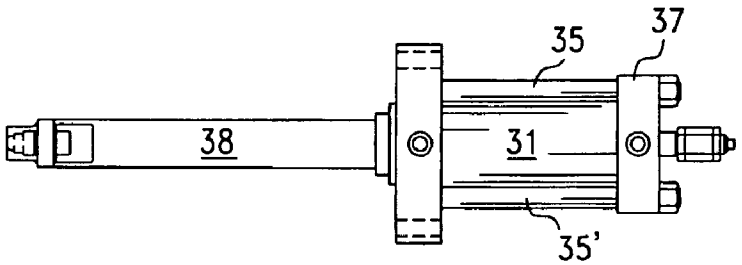
FIG. 4B is a top or plan view of an extended rod for use in practicing the present invention.
Figure 4A:
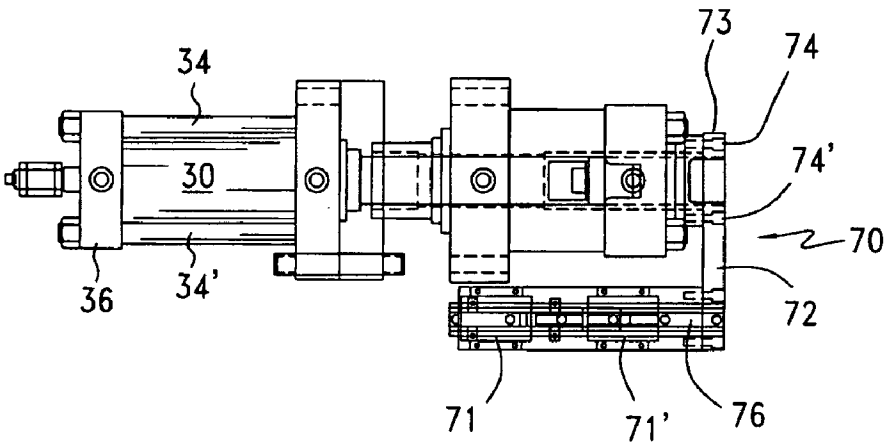
FIG. 4A is a top view of nested hydraulic cylinders of the type used in the cold forging apparatus in accordance with the invention.

The cylinders 30 shown in FIGS. 4A and 4B are of a conventional design. For example, the hydraulic cylinder or presses can be purchased from Miller Fluid Power of Bensenville, Ill. and identified as model H-67B. As shown more clearly in FIG. 4B, an extension rod 38' is operably connected to the cylinder 30 for passing through the cylinder 45'. The cylinder 45' is also of a conventional design, but has been modified by forming a passageway or drilling a hole through the center of the rod to form a tube shaped rod which is internally supported or guided by conventional bronze bearings. The basic cylinder 45 includes a ring-shaped punch. The basic cylinder is available from Miller Fluid Power as a double ended press, Model No. DH 67B.

As shown in FIG. 4A, the apparatus in accordance with the present invention also includes an anti-rotation mechanism 70. The anti-rotation mechanism includes a pair of carriages 71, 71' and arm 72 which is connected to the carriages 71, 71' in a conventional manner at one end thereof. An opposite end 73 of the arm 72 is bolted to the outer or ring-shaped cylinder rod by a pair of bolts 74 and 74'. The carriages 71, 71' move forward and back along a rail 76 with movement of the ring-shaped cylinder rod and prevents the ring-shaped cylinder rod from rotating inside the cylinder. The anti-rotation mechanism is important when the nested punches must be aligned with the die cavity for complex nested profiles, as for example introducing a part with gear teeth or the like.

As illustrated in FIG. 5, a loader 50 may be of a conventional design and may be adjacent to the die carrier 24 or positioned thereon. The loader/unloader 50 includes a pair of air cylinders 52 and 54 for positioning a load blank 53 in front of a die 56. The first cylinder 52 moves a load carrier 55 horizontally from a first position into alignment with the die 56. The second air cylinder 54 then positions the load blank 53 in front of the die where it is delivered into the die 56 by one of the punches. The carrier 55 is then returned to a first position in a conventional manner.

Figure 6:
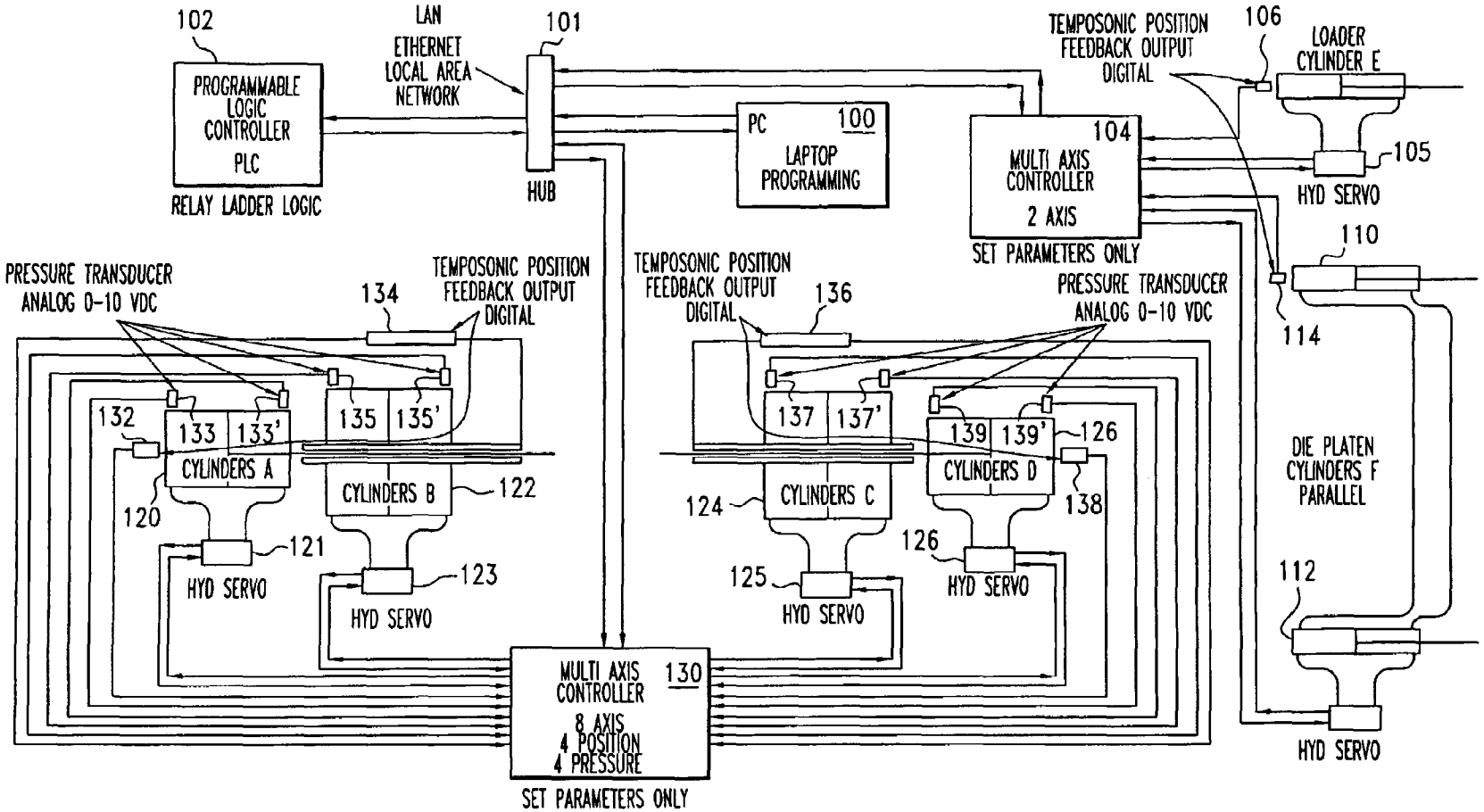
FIG. 6 is a schematic illustration of the control logic for controlling the apparatus in accordance with the present invention.

The operation of the cold forging apparatus disclosed herein is illustrated in FIG. 6. As shown therein, a personal computer 100 such as a laptop is used for programming the programmable logic controller 102 and/or controlling the movement of the punches 10, 12, 20 and 22 (shown in FIGS. 1 and 2) for forming a part having a preselected shape. The computer 100 is operatively connected to a programmable logic control 102 by means of an ethernet local area network (LAN) 101. The LAN 101 is operatively connected to a first multi axis controller 104 which controls a shuttle or other type loader 103. The loader than loads and/or receives a metal slug or a finished part in response to the data from the multi-axis controller. A Tempasonic position feedback output digital device 106 is also operatively connected to multi access controller 104 and feeds back data on the status of the loader 103.

The multi access controller 104 which is operatively connected to a hydraulic servo 105 to control movement of a pair of parallel die platen pistons in die platen cylinders 110 and 112. A second Tempasonic position feedback output device 114 is operably connected to the multi access controller 104 to convey feedback data to the controller 104.

The movement of the four punches 10, 12, 20 and 22 (FIGS. 1 and 2) are actuated by hydraulic cylinders 120, 122, 124 and 126 which are operable by means of hydraulic servos 121, 123, 125 and 127, respectively, in response to data or signals from a second multi access controller 130. The second multi access controller 130 is operably connected to the LAN 101 and is effective in controlling eight parameters i.e., four position and four pressure sensors, one each for each of the punches 10, 12, 20 and 22. The second multi access controller 130 receives data corresponding to the positions of the cylinders or pressures on each of the punches from Tempasonic digital position feedback devices 132, 134, 136 and 138, respectively, and pressure from pressure transducers 133, 135, 137, 138, 133', 135', 137', 138, and 138'. Two pressure transducers are provided for each of the four cylinders with one on each side of the pistons.

The data from the Tempasonic feedback devices 132, 134, 136 and 138, and pressure transducers 133, 135, 137, 139, 133', 135', 137' and 139' is transmitted to the programmable logic controller 102 by means of the LAN 101. The Tempasonic feedback devices and pressure transducers are conventional in design and are available from Miller Fluid Power of Bensenville, Ill.

Programming the movement of each of the punches is effective in producing complex shapes within a single die and also for changing the shapes of the forged parts to be formed. Such programs are well within the skill of a programmer with experience in forging parts based on the diagram as shown in FIG. 6.

An improved conveyor or loader/unloader 200 in accordance with a preferred embodiment of the invention will now be described in connection with FIGS. 7–15. As illustrated therein, a loader/unloader 200 is adapted to receive a work piece 202 from a supply source (not shown) and to convey or transport the work piece 202 to a loading/unloading position 204 adjacent to a die 206 and between a punch 208 and the die 206. The loader/unloader 200 includes a pivot assembly 210 and a J-shaped moveable robot arm 212 with one end 214 attached to the pivot assembly 210 for movement about a central axis 223 about which the pivot assembly rotates.

An opposite end 216 of the J-shaped moveable robot arm 212 includes an end extender 220 having first and second carrier elements 222 and 224 or gripping members. The first carrier element is fixed to the end of the J-shaped robot arm 212 while the second carrier element 224 is pivotally connected to the first carrier element 222 for rotation about a second axis. The end connector 220 is constructed and arranged to receive the work piece 204 between the carrier elements 222 and 224.

The conveyor 200 also includes a servo actuator 230 which may be of conventional design and a crank arm 232 connected at one end thereof to the servo actuator 230. An opposite end of the crank arm is fixed to the end 214 of the J-shaped robot arm 212 through the pivot assembly for rotating the J-shaped robot arm 212 about the pivot assembly 210 in response to the movement of a piston (not shown) and a rod 211 of servo actuator 230. As illustrated, the servo actuator is mounted on the top of a central platen or die carrier 24 as for example, by a mounting bracket 233.

As shown in FIGS. 7–15, a storage area or tray 238 is positioned adjacent to the die carrier 24 for receiving forged products or articles therein. An unloading actuator or pin 240 is also positioned on the die carrier 24 adjacent to the tray 238 and is adapted to engage an outwardly projecting finger 241 which extends outwardly from the carrier element 224. Thus, the actuator pin 240 tilts the element 224 to unload a forged product therefrom.

Figures 7A, 7B:
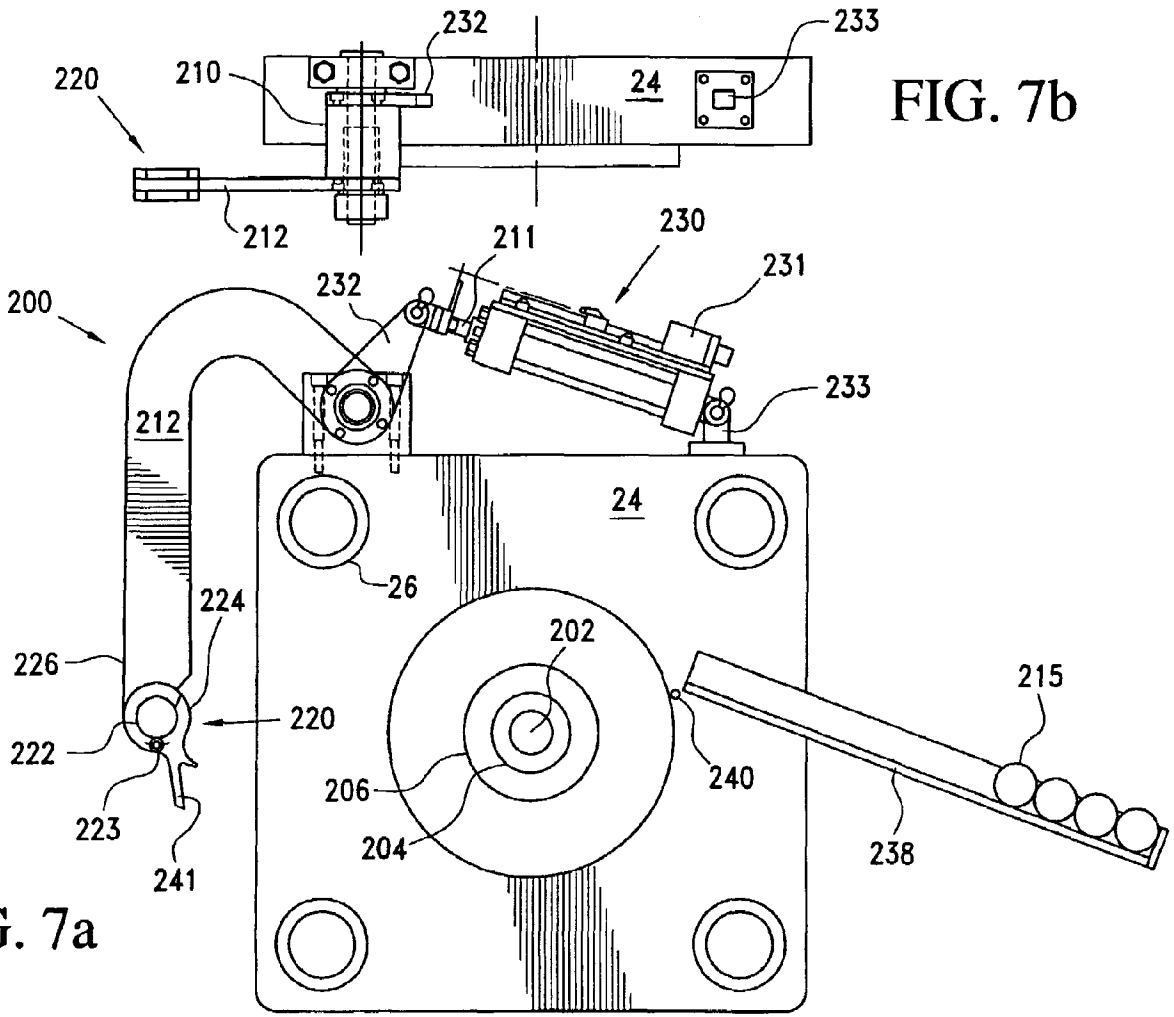
FIG. 7*a* is a front elevational view of a loader/unloader in accordance with the invention wherein the loader/unloader is positioned for receiving a metal work piece into an end extender.
FIG. 7*b* is a top view of the loader/unloader shown in FIG. 7*a* but without a servo actuator.

In the operation of the loader/unloader, the J-shaped robot arm 212 is positioned for receiving a work piece 202 in a generally circular opening defined by the first and second carrier elements 222 and 224 as more clearly illustrated in FIG. 7*a*. The work piece 202 is inserted into the circular opening by a simple punch assembly (not shown), or by other conventional means as will be well understood by persons of ordinary skill in the art.

Figure 8:
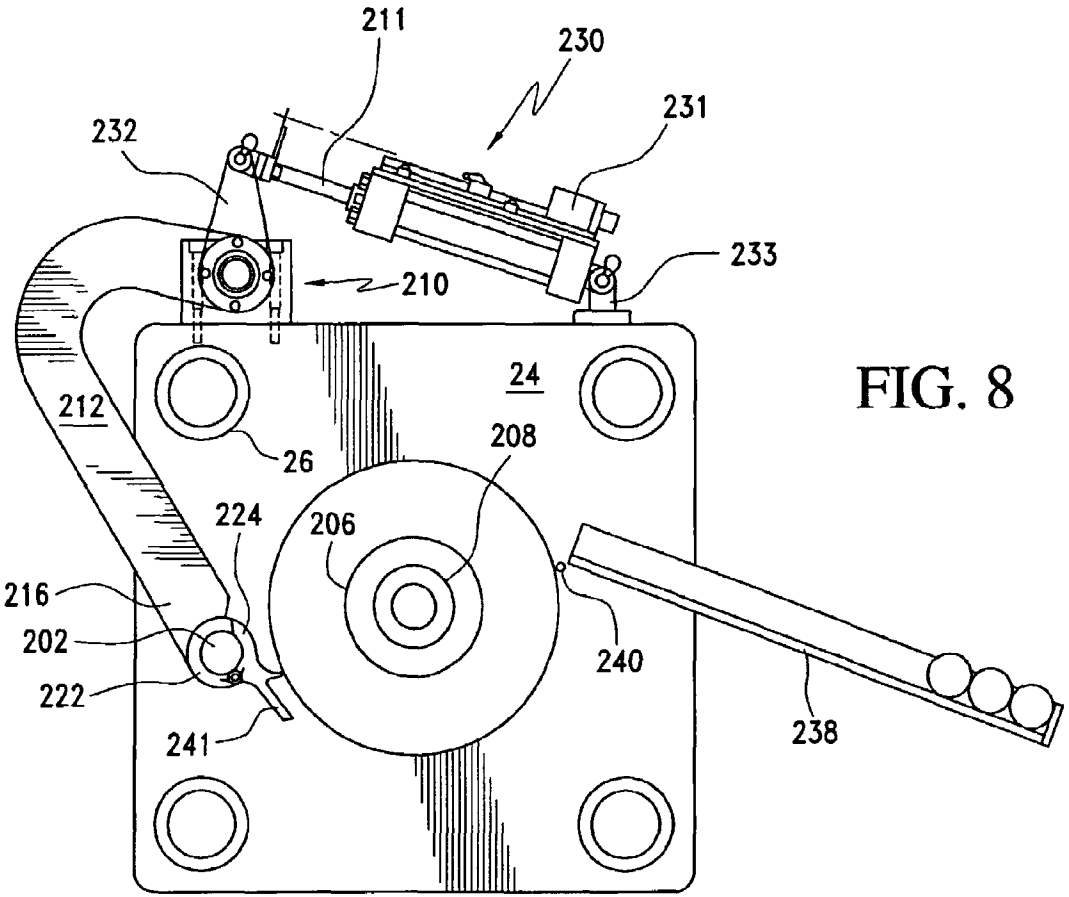
FIG. 8 is a front elevational view of the loader/unloader shown in FIG. 7, but with its robot arm in transition as it transports a work piece to a loading position.
Figure 9:
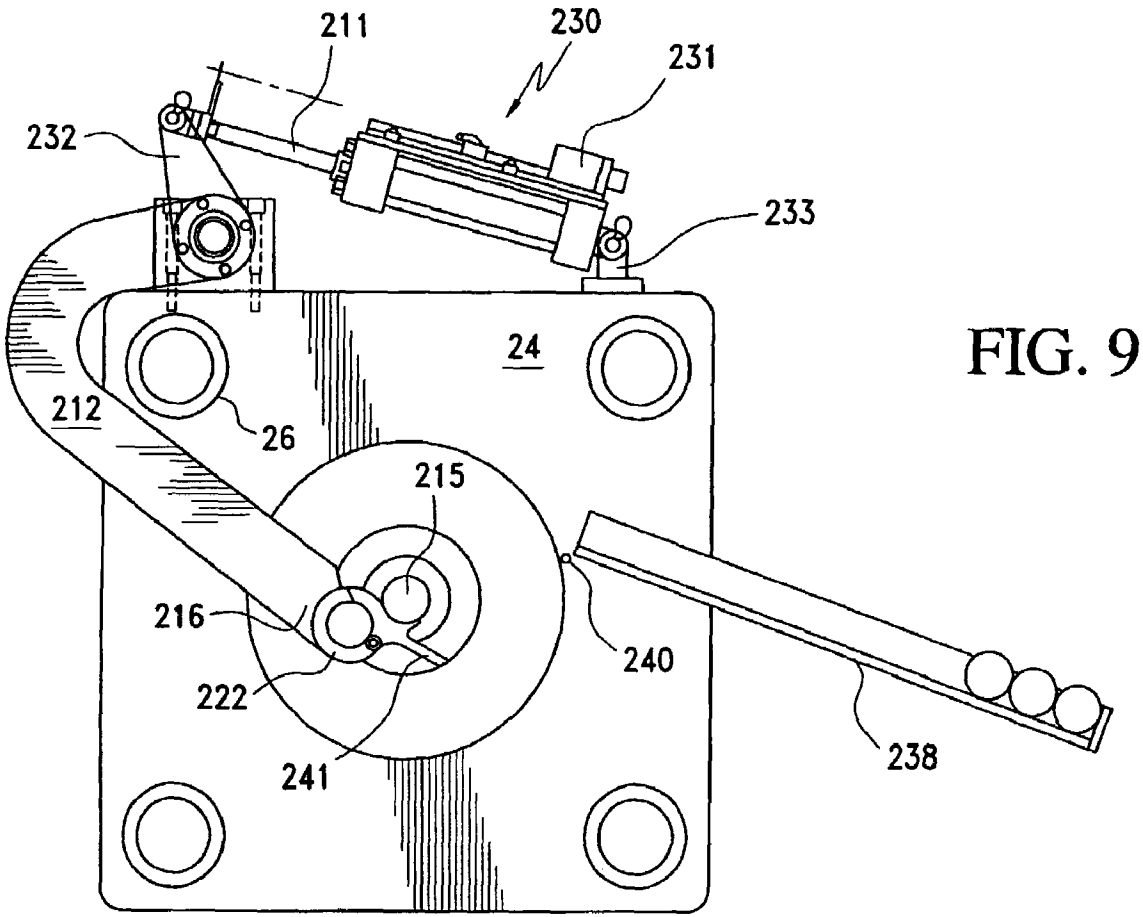
FIG. 9 is a front elevational view of the loader/unloader shown in FIGS. 7 and 8 but with the robot arm end extender in an unloading position.

The robot arm 212 is then rotated about the pivot assembly 210 by means of the actuator 230 acting in response to a signal from a feed back device 231. The actuator 230 rotates the crank arm 232 to thereby rotate the robot arm 212 to move the end extender 220 along an arc shaped pathway (not shown) toward the loading/unloading position 204 as shown in FIG. 8. As the robot arm continues its movement, one of the punches pushes a forged product 215 out of the die 206 and onto a concave upper surface of the second carrier element 224 as shown in FIG. 9. The programming of the robot arm movement in connection with the movement of the punches is well within the skill of a person of ordinary skill in the art.

As illustrated, the pivot assembly 210 is mounted on the die carrier 24 above a rod or bar 26. The J-shape in the robot arm 212 allows the arm to move through its intended pathway without interference from the bar 26.

Figure 10:
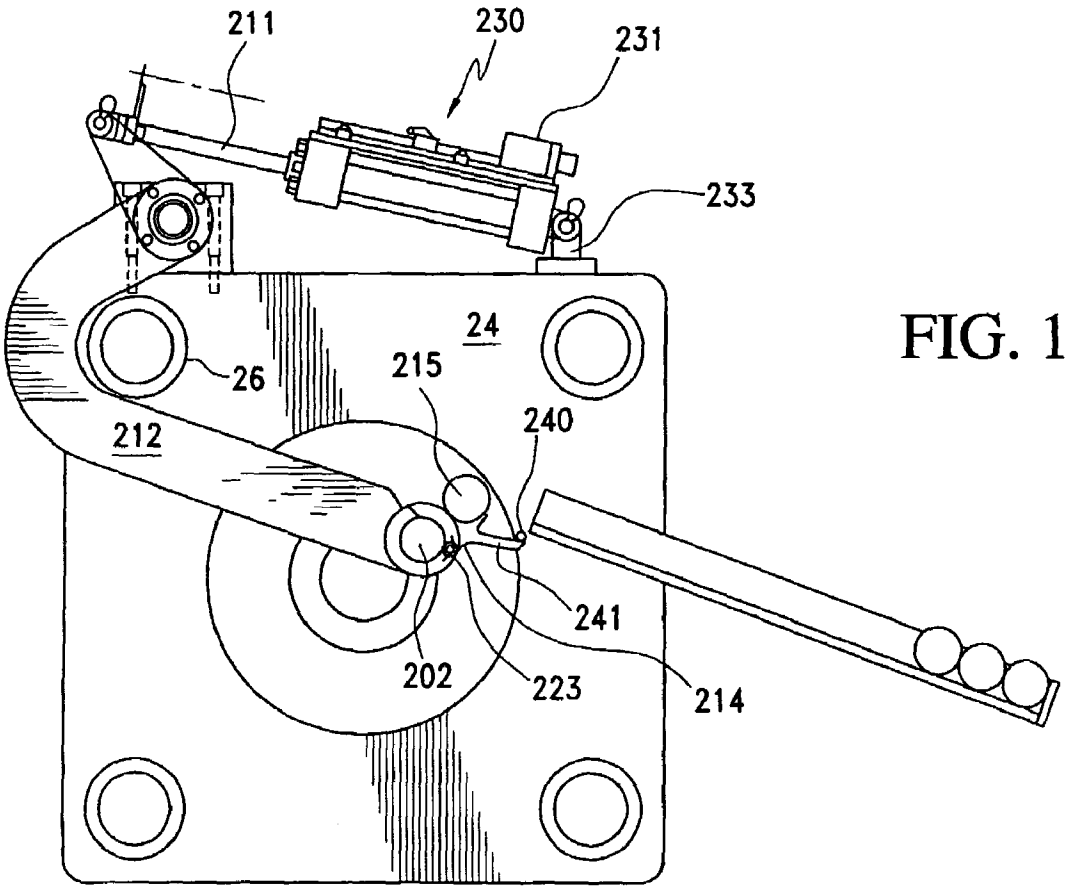
FIG. 10 is a front elevational view of the loader/unloader shown in FIGS. 7–9 but with a forward extending finger of the unloader engaging a pin actuator for initiating deliver of a forged particle to a storage tray.
Figure 11:
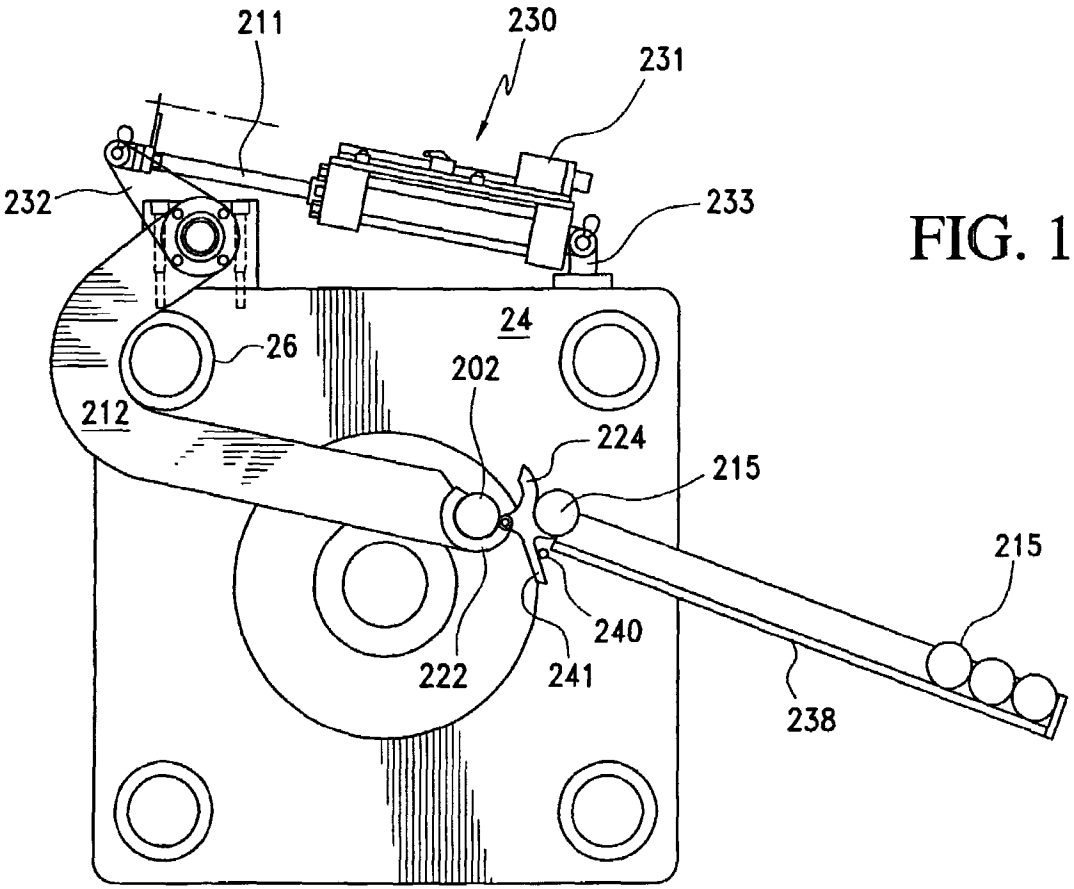
FIG. 11 is a front elevational view of the loader/unloader shown in FIG. 10, but with the loader/unloader delivering a work piece to a storage tray.

FIG. 10 illustrates further movement of the arm 212 along its intended pathway until the outwardly extending finger 241 of the upper carrier element 224 engages the pin 240 and as the arm 212 continues to rotate tilts the second carrier 224 to deliver the forged product 215 to the storage tray 238 as shown in FIG. 11.

Figure 12:
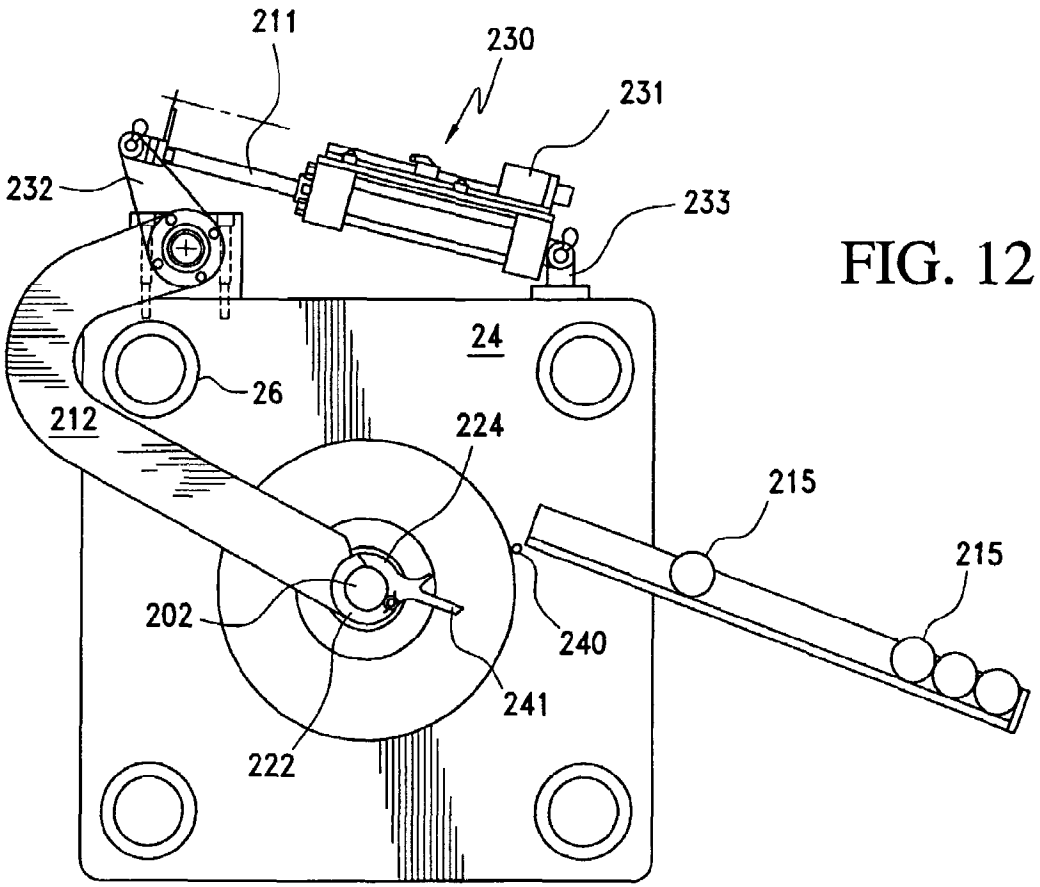
FIG. 12 is a front elevational view of the loader/unloader shown in FIG. 11, but with the loader/unloader positioned for insertion of a work piece into a die.
Figure 13:
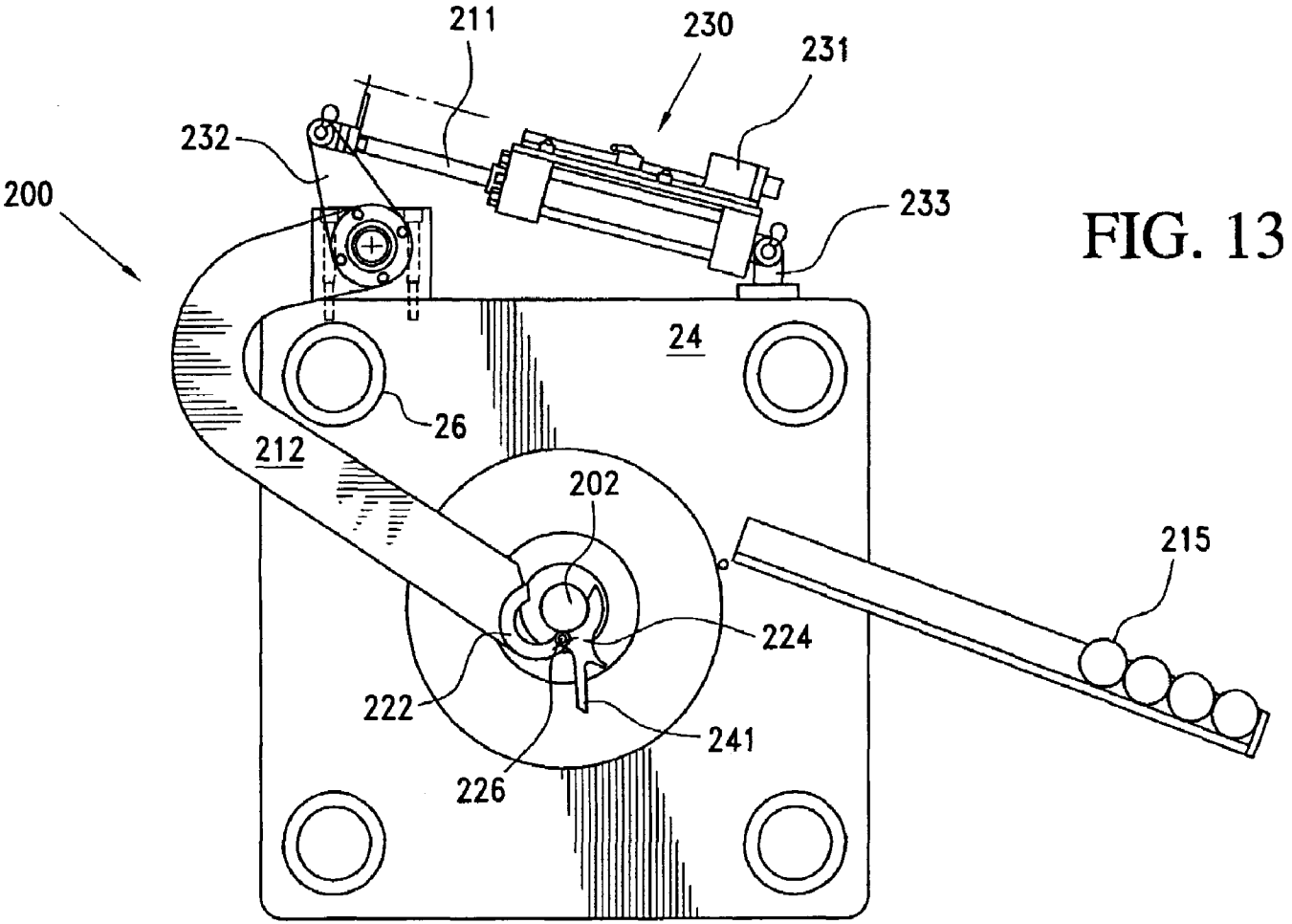
FIG. 13 is a front elevational view of the loader/unloader shown in FIG. 12, but with the robot arm moved partially away from the loading position as a punch (not shown) pushes the work piece into a die.
Figure 14:
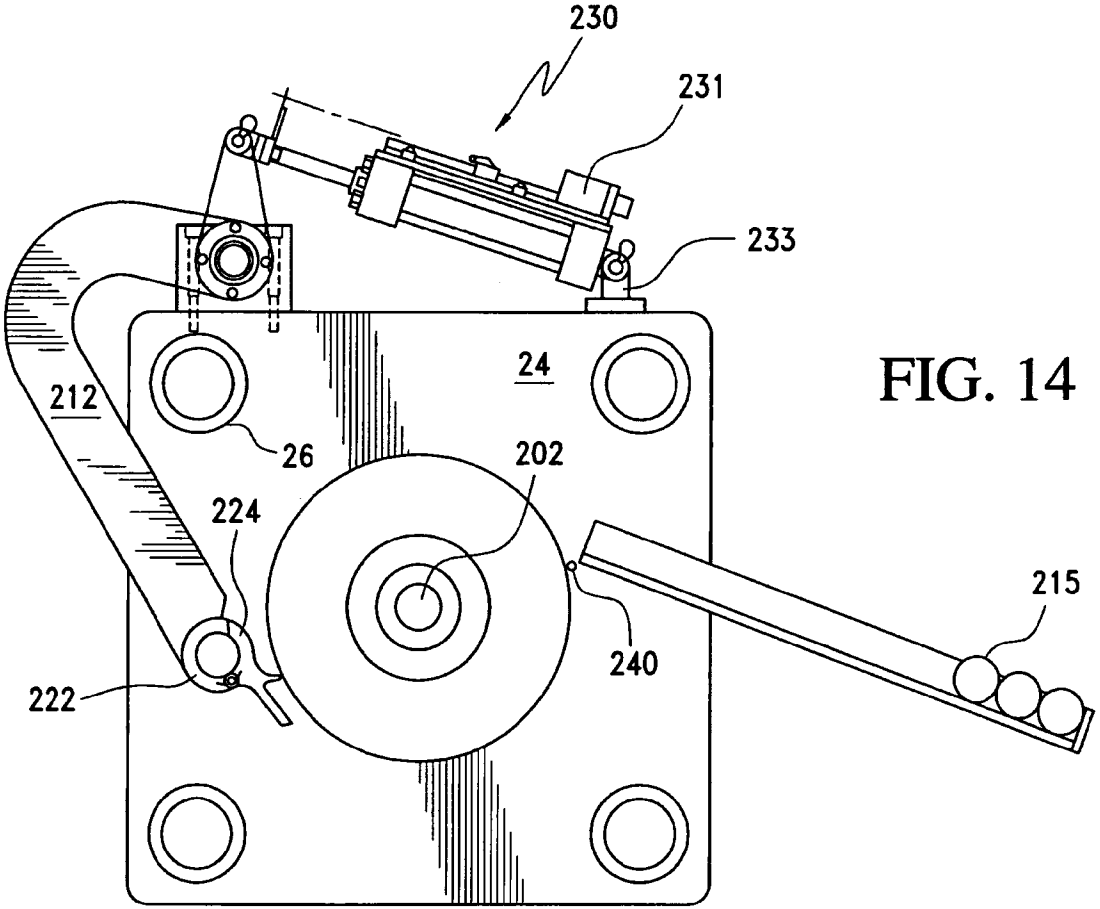
FIG. 14 is a front elevational view of the loader/unloader as shown in FIG. 7–13, but with its robot arm in neutral position as for example, when a die is being changed.
Figure 15:
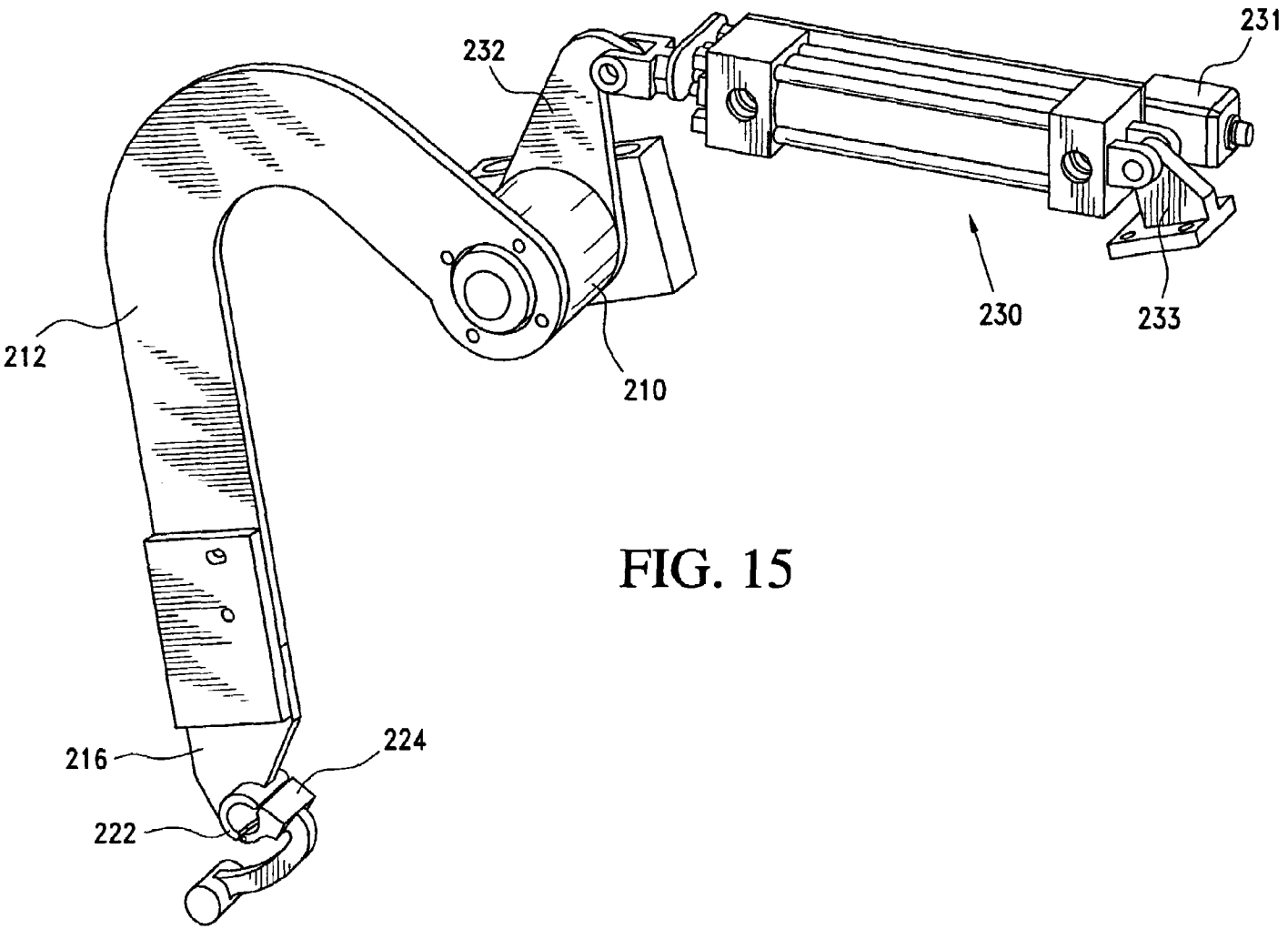
FIG. 15 is a perspective view of a robot arm, end connector, pivot assembly and activator of a loader/unloader in accordance with another embodiment of the present invention.

Following the deliver of a forged product 215 to the storage tray 238, the servo actuator 230 returns the robot arm 212 and end extender 220 to the loading/unloading position as shown in FIG. 12. A punch (not shown) pushes the work piece 202 or metal slug into the die. A further advantage of the pivotally mounted second carrier element is that the robot arm can move before the work piece is fully inserted into the die.

While the invention has been described in connection with its preferred embodiment, it should be recognized that changes and modifications may be made therein without departing from the scope of the claims.

What is claimed is:

1. A conveyor for conveying a metal work piece from a supply source to a loading/unloading position adjacent to and between a die and a punch in a forging apparatus and for conveying a forged product from the loading/unloading position to a storage area, said conveyor comprising:

a pivot assembly and a moveable robot arm having an end effector fixed to one end thereof and an opposite end of said robot arm attached to said pivot assembly for movement about a first axis;

a servo actuator and a crank arm connected at one end thereof to said servo actuator and at an opposite end to said pivot assembly for rotating said robot arm about said first axis in response to movement of said servo actuator and means for controlling movement of said servo actuator;

said end effector including first and second carrier elements with said first carrier element fixed to said robot arm and said second carrier element pivotally connected to said first carrier element for rotation about a second axis and said first and said second carrier elements adapted to receive a work piece therebetween when in a closed position;

said second of said carrier elements including a concave upper portion adapted to receive a forged product thereon when in a closed position and an outwardly extending finger;

an unloading actuator for engaging said outwardly engaging finger as said robot arm rotates about said first axis to move said second carrier element into an unloading position to deliver the forged product to a storage area, and means for returning said second carrier element to its closed position after delivery of said forged product.

2. A conveyor for conveying a metal work piece from a supply source to a loading/unloading position adjacent to and between a die and a punch in a forging apparatus and for conveying a forged product from the loading/unloading position to a storage area, said conveyor according to claim 1 in which said means for returning said second carrier element to its closed position is gravity actuated.

3. A conveyor for conveying a metal work piece from a supply source to a loading/unloading position adjacent to and between a die and a punch in a forging apparatus and for conveying a forged product from the loading/unloading position to a storage area, said conveyor according to claim 1 in which said means for retaining said second element to its closed position is an offset weight.

4. A conveyor for conveying a metal work piece from a supply source to a loading/unloading position adjacent to and between a die and a punch in a forging apparatus and for conveying a forged product from the loading/unloading position to a storage area, said conveyor according to claim 1 in which said means for returning said second element to its closed position is a spring.

5. A conveyor for conveying a metal work piece from a supply source to a loading/unloading position adjacent to and between a die and a punch in a forging apparatus and for conveying a forged product from the loading/unloading position to a storage area, said conveyor according to claim 1 in which said moveable robot arm is J-shaped.

6. A conveyor for conveying a metal work piece from a supply source to a loading/unloading position adjacent to and between a die and a punch in a forging apparatus and for conveying a forged product from the loading/unloading position to a storage area, said conveyor according to claim 5 in which said first and second carrier elements define an opening for encircling a generally cylindrical work piece in sliding engagement therewith whereby a press punch can push the work piece out of the end effector and into a die.

7. A cold forging apparatus for performing multiple functions at a single station to form complex shapes, said apparatus comprising:

a first multiple punch assembly including a first inner punch and a first outer punch moveable along a first common axis with respect to one another, a second moveable punch assembly including a second inner punch and a second outer punch moveable along said common axis in a confronting relationship with said first punch assembly, and means for moving said punches individually along said common axis, and means for positioning a die between said first multiple punch assembly and said second multiple function punch assembly for receiving and containing a work piece, a programmable logic controller, multi axis controller and means including a feed back device for controlling movement of said punches along said axis;

said apparatus also including a loading/unloading position between said punch assemblies and a conveyor for conveying a metal work piece from a supply source to said loading/unloading position and for conveying a forged product from said loading/unloading position to a storage area and wherein the movement of said conveyor is controlled by said feed back device and wherein the work piece is moved into said die by one of said punches; wherein said first inner punch is surrounded by said first outer punch and in sliding engagement therewith;

wherein each said inner punches are surrounded by one of said outer punches and is in sliding contact therewith;

wherein said conveyor includes a first pivot assembly and a moveable robot arm having an end effector fixed to one end thereof and an opposite end of said robot arm attached to said pivot assembly for rotation about a third axis and means including a servo actuator for rotating said robot arm about said third axis in response to movement of said servo actuator and wherein said movement of said servo actuator is controlled by said feed back device;

wherein said means including a servo actuator for rotating said robot arm includes a crank arm operatively connected at one end thereof to said servo actuator and at its opposite end to said robot arm;

wherein said third axis is parallel to said common axis; and, wherein said end effector includes first and second carrier elements with said first carrier element fixed to said robot arm and said second carrier element pivotally attached to said first carrier and said first and second carrier elements adapted to receive a work piece therebetween in slidable engagement therewith and adapted to position the work piece adjacent to said die for insertion therein by one of said punches.

8. A cold forging apparatus for performing multiple functions at a single station to form complex shapes, said apparatus according to claim 7 which includes a storage tray for forged products and in which said second carrier element includes a concave surface and an outwardly extending finger and is adapted to receive a forged product pushed out of said die and onto said concave surface and to convey said forged product to said storage tray and means for engaging said outwardly extending finger to tilt said second carrier element to thereby deliver the forged product to said storage tray.

9. A cold forging apparatus for performing multiple functions at a single station to form complex shapes, said apparatus according to claim 8 which includes means for biasing said second carrier element into a closed position with respect to said first carrier element to thereby form a generally circular opening therebetween for receiving a work piece and which said biasing means is an offset weight.

10. A cold forging apparatus for performing multiple functions at a single station to form complex shapes, said apparatus according to claim 8 which includes means for biasing said second carrier element into a closed position with respect to said first carriage element to thereby form a generally circular opening therebetween for receiving a work piece and in which said biasing means is a spring.

11. A cold forging apparatus for performing multiple functions at a single station to form complex shapes, said apparatus according to claim 7 in which said robot arm is generally J-shaped.

* * * * *